US006913066B2

(12) United States Patent
Holzgruber et al.

(10) Patent No.: US 6,913,066 B2
(45) Date of Patent: Jul. 5, 2005

(54) METHOD AND DEVICE FOR PRODUCING INGOTS OR STRANDS OF METAL BY MELTING ELECTRODES IN AN ELECTROCONDUCTIVE SLAG BATH

(75) Inventors: Wolfgang Holzgruber, Mur (AT); Harald Holzgruber, Mur (AT); Lev Medovar, Kyiv (UA); Izrail Lantsman, Kyiv (UA)

(73) Assignee: Inteco Internationale Technische Beratung Ges. mbH, Mur (AT)

( * ) Notice: Subject to any disclaimer, the term of this patent is extended or adjusted under 35 U.S.C. 154(b) by 68 days.

(21) Appl. No.: 10/416,823

(22) PCT Filed: Nov. 9, 2001

(86) PCT No.: PCT/EP01/13012

§ 371 (c)(1),
(2), (4) Date: May 14, 2003

(87) PCT Pub. No.: WO02/40726

PCT Pub. Date: May 23, 2002

(65) Prior Publication Data

US 2004/0040688 A1 Mar. 4, 2004

(30) Foreign Application Priority Data

Nov. 14, 2000 (AT) ..... A 1905/2000

(51) Int. Cl.[7] ..... B22D 27/02
(52) U.S. Cl. ..... 164/470; 164/509
(58) Field of Search ..... 164/469–470, 164/495, 509, 514–515

(56) References Cited

FOREIGN PATENT DOCUMENTS

EP 800879 * 10/1997

* cited by examiner

*Primary Examiner*—Kuang Y. Lin
(74) *Attorney, Agent, or Firm*—Bachman & LaPointe, P.C.

(57) ABSTRACT

A method for producing metallic ingots or strands, especially from steel and Ni and Co based alloys, by melting self-consuming electrodes in an electroconductive slag bath, using an alternating current or a direct current in a short water-cooled mold which opens downwards, via which an electric contact can be produced for the slag bath. The supplied melt current is passed via the consumable electrode, the bottom plate, the remelt ingot and the melting bath, and optionally at least one electroconductive element of the mold, to the slag bath. The current distribution can be regulated in a controlled manner and the return circuit of the melt current passes back via at least one other electroconductive element of the mold, which is electrically isolated in relation to a first part of the mold which forms the remelt ingot. The proportion of the entire melt current supplied via the bottom plate is selected between 0 and 100%. The device for carrying out the method uses a short, water-cooled mold having a bottom plate for creating a remelt ingot, and having at least one electroconductive element which is provided in the region of the slag bath. The element is isolated in relation to the lower region of the mold, which forms the remelt ingot, and/or in relation to other electroconductive elements.

19 Claims, 3 Drawing Sheets

Fig. 2
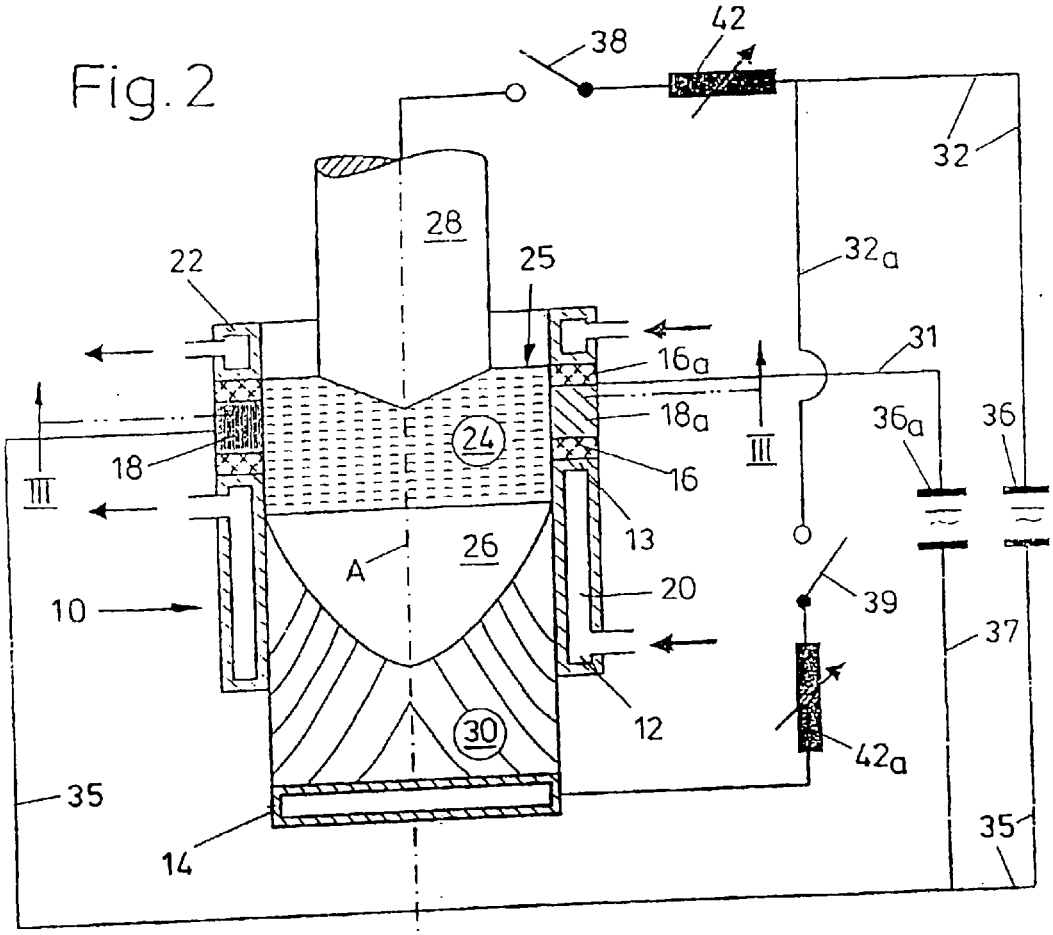
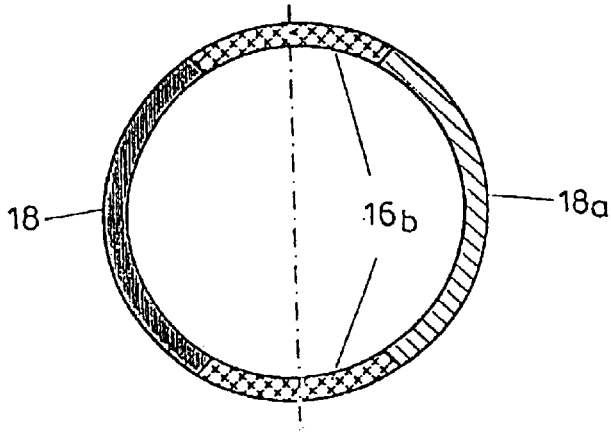
Fig.3

METHOD AND DEVICE FOR PRODUCING INGOTS OR STRANDS OF METAL BY MELTING ELECTRODES IN AN ELECTROCONDUCTIVE SLAG BATH

BACKGROUND OF THE INVENTION

The invention concerns a method of producing ingots or billets of metal—in particular steels and Ni- and Co-based alloys—by melting self-consuming electrodes in an electrically conductive slag bath using alternating current or direct current in a short, downwardly open water-cooled mold by way of which current contact with the slag bath can be made. The invention further concerns an apparatus for carrying out that method.

When producing remelt ingots In accordance with the method of electro-slag remelting in stationary chill molds—but also in short sliding chill molds—it is usual, depending on the susceptibility to segregation of the remelted alloy, to set a melting rate in kilograms (kg) per hour, which in the case of round ingots is between 70% and 110% of the ingot diameter in millimeters (mm). In the case of ingot shapes which differ from a round cross-section such as square or flat formats, it is possible to operate with an equivalent diameter which is calculated from the periphery of the cross-section, divided by the number Π (pi). The lower range is used in particular in relation to severely segregating alloys—such as tool steels or highly alloyed nickel-based alloys—, in relation to which the aim is to have a shallow metal sump for the avoidance of segregation phenomena. It is however scarcely possible to get below the value of 70% in the conventional electroslag remelting process as then the supply of power from the melting electrode into the slag bath has to be very greatly reduced, and that results in a low temperature of the slag bath and, as a further consequence, a poor, often grooved surface of the remelt ingot. With an excessively low supply of power to the slag bath a thick coating of slag is then also formed in many cases between the ingot and the mold, which in turn impedes the dissipation of heat from the surface of the ingot so that once again it is not possible to achieve the desired shallow molten bath sump. On the other hand however even in the case of steels and alloys which are less sensitive to segregation, it is not possible to exceed a value of 110% in the case of the conventional electroslag remelting process, referred to as the ESR method, as otherwise overheating of the slag bath together with the increased melting rate results in a molten bath sump which is unacceptably deep for remelt ingots, and thus an undesirably coarse ingot structure—linked to segregation phenomena. As can be readily seen from the foregoing, in the conventional ESR method in which the melting current is passed into the slag bath by way of the melting electrode and is removed again by way of the remelted ingot and the bottom plate, the slag bath temperature and the melting rate—and related thereto the sump depth and the nature of the surface—are closely linked together and cannot be monitored and controlled independently of each other and separately.

When producing remelt ingots of large diameter of 1000 mm and above, it is found that observing the above-indicated, desired low melting rates, particularly when using melting electrodes of large diameter, corresponding to 65 to 85% of the chill mold diameter, results in an excessively low slag bath temperature which then in turn results in the remelt ingot having a poor, often grooved surface. If in that case the supply of power to the slag bath is increased, that admittedly results in an improvement in the ingot surface, but at the same time that causes an increase in the melting rate above the admissible limit, which results in a deeper molten bath sump and disadvantageous hardening. That increase in the melting rate with an increased supply of power to the slag bath occurs for the reason that the melting electrode serves on the one hand to supply energy to the slag bath, but on the other hand it melts away correspondingly more quickly, the more the supply of energy to the slag bath is increased. The electrode then has to be suitably adjusted by movement into the slag bath at the speed at which it melts away. If the melting electrode were not adjusted in that way, it would melt away until just above the surface of the slag bath, whereby electrical contact and thus the supply of power to the slag bath would be interrupted. The remelting procedure would thus come to a stop.

Another way of increasing the slag bath temperature is that of remelting electrodes of smaller diameter. In that case the end face of the electrode, which dips into the slag bath, is smaller so that a comparatively hotter slag bath is required in order to achieve the desired melting rate. Admittedly, in many cases it is possible in that way to achieve an improvement in the surface of the ingot, but the use of electrodes of small diameter results in an increased concentration of heat in the center of the ingot, which can result in a sump which is depressed in a V-shape, with an increased tendency to segregation.

The cause of all the above-indicated difficulties is the fact that on the one hand the melting rate of the electrode is controlled by the energy which is fed to the slag bath by way of the electrode, and on the other hand it is precisely that feed of energy that must also be sufficient to keep the molten bath sump sufficiently fluid as far as the edge thereof and reliably to prevent a temporary progression of hardening beyond the meniscus of the molten bath sump. More specifically, if an excessively low temperature of the slag bath temporarily causes such a progression of hardening beyond the meniscus, that results in the formation of a grooved surface which is detrimental in terms of further processing of the ingots.

Industrial electroslag remelting installations are nowadays operated practically exclusively with alternating current, although alternating current installations result in not inconsiderable active and reactive losses in cases involving high current strengths as are usual in electroslag remelting. Those disadvantages however are tolerated as, when using alternating current, both good metallurgical results and also acceptable energy consumption figures are achieved. The attempt was already made at the beginning of technical use of the ESR method to operate the method with direct current. In that case, with the melting current being conducted by way of the electrode, the slag bath, the ingot and the bottom plate, as is usual in conventional ESR-installations, it was found that, irrespective of the circuitry of the installation, the liquid metal always formed both the cathode and also the anode either at the electrode tip or in the molten bath sump. In principle it would be desirable to connect the liquid metal as the cathode as the progress of metallurgical refining reactions such as the breakdown of oxygen and sulfur is promoted at the cathode interface. On the other hand only little heat is liberated at the cathode in the current transfer, as there the transfer resistance is low, by virtue of the accumulation of extremely mobile small cations. At the anode where large anions which have poor mobility accumulate, the transfer resistance for the electrical current and therewith the energy yield are admittedly great, but it is necessary to reckon on anions such as oxygen, sulfur and so forth to be picked up from the slag, which results in a worsening of the quality of the remelted metal. In contrast thereto, when carrying out a remelting process with alternating current, the polarity of the interface, both at the electrode tip and also at the phase boundary between the slag and the molten metal bath, constantly changes with the frequency of the alternating current used. That results on the one hand in relatively good utilisation of the current afforded for melting the electrode metal and on the other hand it results in good metallurgical results as the constant change in the polarity at the phase interfaces promotes the attainment of a condition of thermodynamic equilibrium. If however the attempt is successfully made to connect all phase boundaries which occur between the metal and the slag as a cathode, basically a further improvement in the metallurgical results is to be expected.

The present applicants' DE 196 14 192 C1 discloses a short-water-cooled and downwardly open mold for producing ingots or billets in accordance with the ESR method or extrusion method, in which the meniscus of the casting surface is covered by an electrically conductive slag. In the region of the slag bath above the casting surface that mold includes current-conducting elements which are not directly water-cooled and by way of which contact can be made with a current source. The material used for those current-conducting elements is graphite or a metal with a high melting point—for example W, Mo, Nb or the like. In a particular embodiment the current-conducting elements can be electrically insulated with respect to the water-cooled part and with respect to each other by elements which are not water-cooled and which do not conduct the current—being made for example from ceramic.

EP 0 786 531 A1—which also originates from the present applicants—discloses a method of continuously remelting metals—in particular steels and Ni- or Co-based alloys—in a short, downwardly open water-cooled mold; to produce a billet it is produced either by continuous or stepwise withdrawal from the mold—or with a stationary billet by suitable lifting movement of the mold. In order on the one hand to ensure a sufficiently high—and thus economical—melting rate and on the other hand a high quality for the remelt billets, the cross-sectional area of the melting electrode should be at least 0.5 times the cross-sectional area of the remelt billet and the melting rate should be so adjusted that it corresponds to between 1.5 and 30 times the equivalent billet diameter calculated from the periphery of the casting cross-section.

In consideration of those factors the inventor set himself the aim of being able to control the melting rate of the electrode independently of the temperature of the slag bath and at the same time to ensure a good ingot surface. In addition the inventor seeks to provide that, when using direct current, both the end face of the melting electrode and also the surface of the molten bath sump can be connected as a cathode.

SUMMARY OF THE INVENTION

The foregoing object Is attained in a surprisingly simple fashion if, for remelting self-consuming electrodes under slag, a per se known chill mold is used, with current-conducting elements which are fitted into the wall of the mold in the region of the slag bath and which are electrically insulated with respect to the lower part of the mold, which shapes the remelt ingot, wherein said elements can also be insulated from each other when using at least two such current-conducting elements. In that way it is possible to feed energy to the slag bath by way of the current-conducting elements in the wall of the mold or to remove energy from the slag bath, and to heat it independently of the feed or return of current by way of the electrode or the ingot so that the metal sump can be kept fluid as far as the edge over the meniscus. On the other hand the melting rate of the consumable electrode can be controlled in a simple manner by the speed of advance movement with which it is advanced into the overheated slag bath. In that respect, the melting rate which can be achieved will be correspondingly higher, the larger the end face and the depth of immersion of the cathode which dips into the slag bath, and the higher the temperature of the slag bath. In that respect, the melting electrode can be completely current-less. It,is however also possible for a part of the current to be passed by way of the electrode. Here it may be an attractive proposition if the part of the current which Is passed by way of the electrode is a direct current which is so connected that the electrode forms the negative pole and is therefore the cathode. In principle the ingot sump can also remain current-less or can be subjected to the action of a part of the current. When using direct current, a form of connection as the cathode is also an attractive proposition, in relation to the ingot sump, for the above-specified reasons. If the ingot and the electrode are connected as the cathode, the return can be by way of the current-conducting elements in the mold, which are connected as the anode.

The remelt ingots which are shaped in the lower part of the mold can either be withdrawn downwardly therefrom or the mold is lifted as the Ingot standing on a bottom plate grows.

The subject of the present invention is therefore a method of producing ingots or billets of metals, In particular steels and Ni- and Co-based alloys by melting self-consuming electrodes in an electrically conducting slag bath in a short, downwardly open water-cooled mold with current-conducting elements which are fitted into the wall of the mold and by way of which a current contact can be made with the slag bath in per se known manner, wherein the supplied melting current can be introduced Into the slag bath both by way of the remelt ingot and the molten bath sump and possibly at least one current-conducting element of the mold, wherein the return of the melting current is effected by way of at least one current-conducting element of the mold which is electrically insulated with respect to a first one if provided and also the part of the mold, which shapes the remelt ingot. In addition it has proven to be desirable if the proportion of current supplied by way of the melting electrode can be 0 to 100% of the total melting current supplied.

This method according to the invention which is set forth here from the point of view of its principle can be adapted in many ways to the requirements of the operator.

Thus for example the short, current-conducting mold can be fixedly installed in a working platform and the remelt ingot can be drawn off downwardly.

It is however also possible for the ingot to be built up on a fixed bottom plate and for the mold to be lifted as the ingot grows. The operation of withdrawing the ingot or lifting the mold can be effected continuously or stepwise.

There is also the possibility of causing the mold to oscillate, which can be an attractive proposition in particular when the ingot is drawn off continuously.

In the case of a stepwise movement for withdrawing the ingot or a stepwise movement for lifting the mold, each lifting step can additionally be directly followed by an opposed step, in which respect the length of that step can be up to 60% of the step length of the withdrawal stepping movement.

BRIEF DESCRIPTION OF THE DRAWINGS

Further advantages, features and details of the invention will be apparent from the description hereinafter of preferred embodiments by way of example and with reference to the drawing in which:

FIGS. 1, 2 and 4 each show a view in longitudinal section through a casting apparatus for metals with a chill mold, and FIG. 3 shows a-view on an enlarged scale in section through FIG. 2 taken along line III—III thereof.

DETAILED DESCRIPTION

Figure 1:
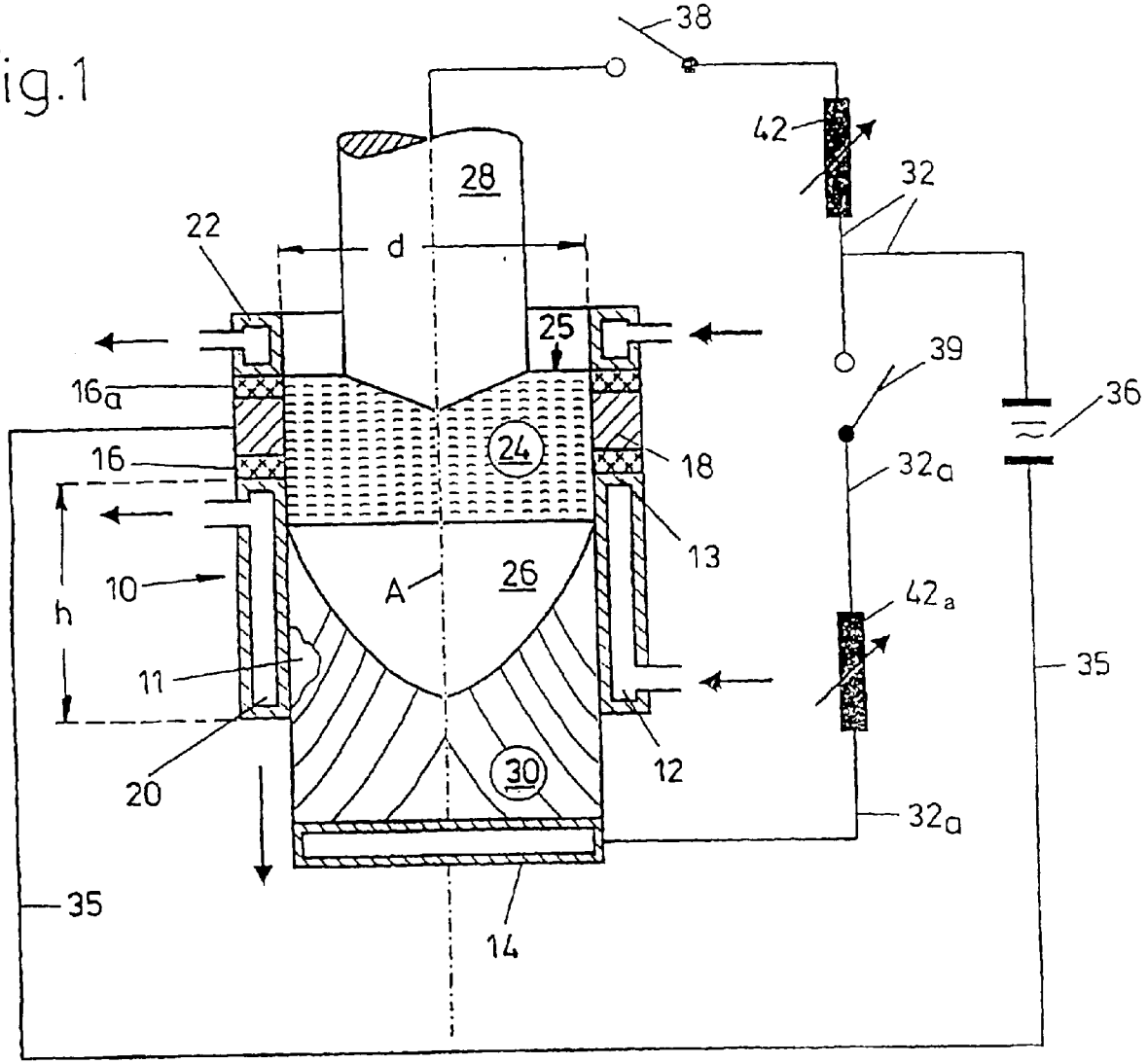

As shown in FIG. 1, associated from below with a water-cooled chill mold 10 with a hollow annular mold body 12 is a bottom plate 14—which is in turn hollow—and the outside diameter of which is slightly shorter than the inside diameter d of the mold 10; to start the installation, the bottom plate 14 can be pushed into the mold opening or the internal space 11 of the mold of the height. h, until it extends directly beneath the upper edge 13 of the mold hollow body 12.

An annular insulating element 16 rests on the upper edge 13 and a current-conducting element 18—which is also of a ring-like configuration and/or is composed of a plurality of parts—rests on the insulating element 16; the current-conducting element 18 is electrically insulated by the insulating elements 16—which do not conduct the current—in relation to the water-cooled lower region 20 of the mold 10 and is separated upwardly by an upper insulating element $\mathbf{16}_a$ from a hollow ring 22 which in turn is water-cooled, as the upper region. It will be noted however that the upper insulating element $\mathbf{16}_a$ is not absolutely necessary for the use according to the invention of the installation described here.

Supported on the bottom plate 14—beneath a slag bath 24 and a sump 26 covered thereby—is a remelt ingot or pre-ingot 30 which is produced by a remelting process with self-consumable electrode 28 and which is shaped in the water-cooled lower region 20 of the mold 10. In order to start the procedure, for example liquid slag can be poured into the mold gap delimited by the mold 10 and the electrode 28 until the level of slag 25 of the resulting slag bath 24 has approximately reached the upper edge of the current-conducting element 18.

The feed of the melting current to the slag bath 26 from an alternating current or direct current source 36 is effected—depending on the respective position of heavy-current contacts 38 and 39—in heavy-current lines 32, $\mathbf{32}_a$, either only by way of the electrode 28 or only by way of the bottom plate 14, the remelt ingot 30 and the molten bath sump 24 or however by way of the electrode 28 and the bottom plate 14 at the same time, wherein the proportions of the current flowing by way of the electrode 28 and the bottom plate can be adjusted as desired by regulatable resistors 42, $\mathbf{42}_a$ or other devices which are comparable in terms of their effect. In this arrangement, the return of the entire melting current is effected exclusively by way of the current-conducting element 18 which is fitted into the wall of the mold and a return line 35 connecting the element 18 to the current source 36.

In another arrangement as shown in FIG. 2, the mold 10 is provided with at least two current-conducting elements 18, $\mathbf{18}_a$ which are insulated by insulating elements 16, $\mathbf{16}_a$ both relative to each other and also relative to the lower region 20 of the mold 10 and—here necessarily—relative to the upper region 22 of the mold 10, namely the hollow ring 12. In that respect FIG. 3 shows two respective part-circular current-conducting elements 18, $\mathbf{18}_a$ which are separated from each other by suitably shaped insulating elements $\mathbf{16}_b$—forming a ring with them; if—as described here—two or more current-conducting elements 18, $\mathbf{18}_a$ which are at different potentials are required, then, particularly in the case of molds 10 of circular cross-section around a longitudinal axis A, the current-conducting elements can be of a circular configuration in the form of a ring and can be arranged one above the other and can be insulated relative to each other by the insulating elements 16 which are arranged therebetween and which are also in the form of a ring.

Here there is the possibility of applying the feed of current between the mold 10 and the current source from two alternating current or direct current sources 36, $\mathbf{36}_a$ to only one of the current-conducting elements 18 or $\mathbf{18}_a$. Those current-conducting elements 18, which are at different potentials can in that case be divided to a plurality of individual elements over the periphery of the mold 10—each being insulated relative to each other. The return of the current can then be effected by way of the respective other current-conducting element $\mathbf{18}_a$ or 18.

Current can be passed into the slag bath 26 from the current source 36 shown at the right in FIG. 2, depending on the respective position of the heavy-current switches 38, 39, either only by way of the electrode 28 through the line 32 or only by way of the bottom plate 14 together with the ingot 30 through the line 32,, or by way of both jointly. When the current is fed by way of the bottom plate 14 and the ingot 30 jointly, the distribution of the current can be adjusted by means of regulatable resistors 42, $\mathbf{42}_a$. The current return can then be effected by way of one of the two current-conducting elements—here 18—of the mold 10 and the return line 35. From the return line 35 a branch line 37 leads to the left-hand current source $\mathbf{36}_a$ which on the other hand is connected by a line 31 to the current-conducting element $\mathbf{18}_a$. If the current source 36 is a direct current source, it is possible for the electrode 28 and the ingot 30 to be connected as the cathode.

If—as described here—two or more current-conducting elements 18, $\mathbf{18}_a$ which are at different potentials are required, then, particularly in the case of molds 10 of circular cross-section, the elements can also be of a circular configuration in the form of a ring and can be arranged one above the other and insulated relative to each other by insulating elements which are arranged therebetween and which are also in the form of a ring.

Figure 4:
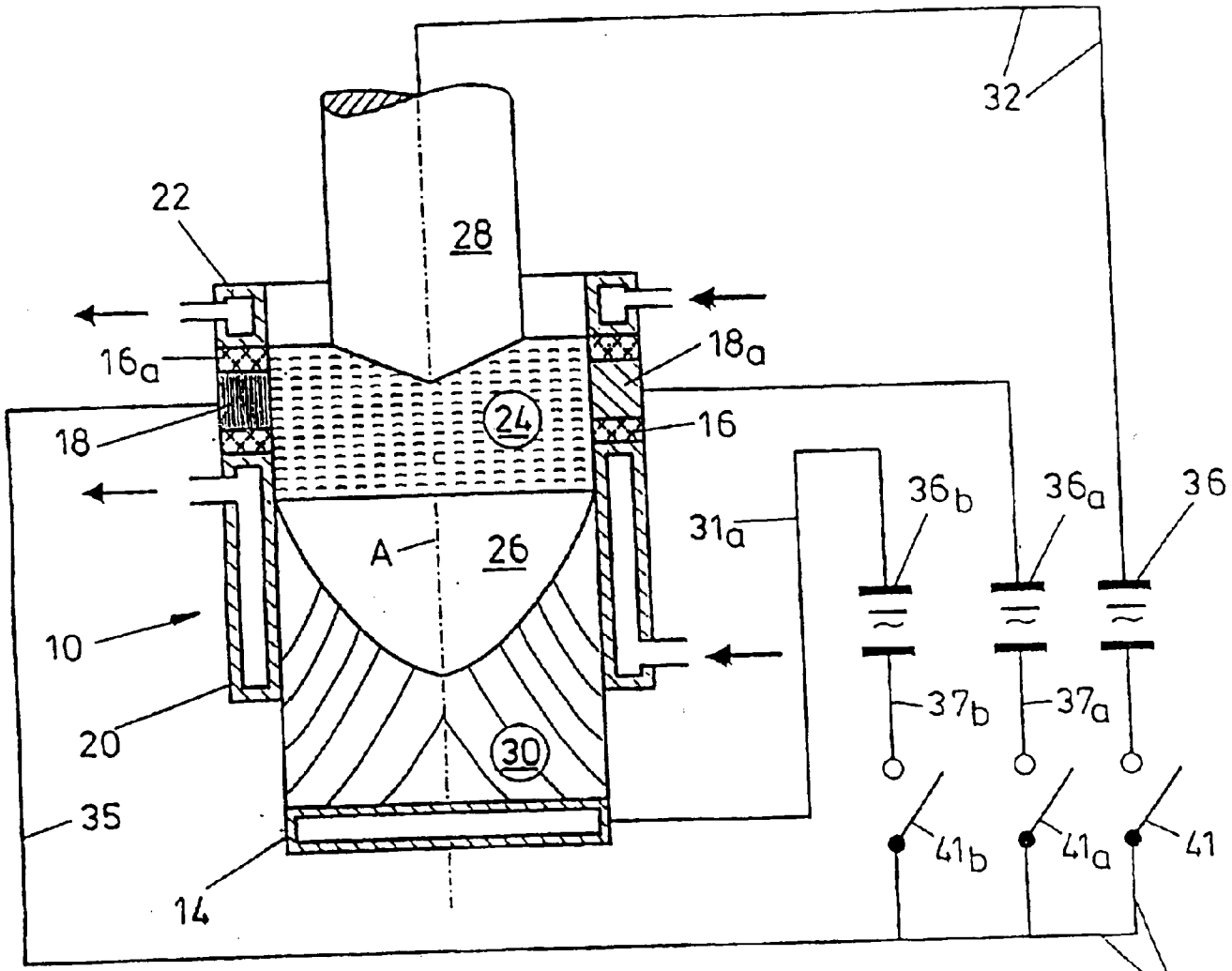

FIG. 4 shows an arrangement for carrying out the method according to the invention with three melting current supply means or current sources 36, $\mathbf{36}_a$, $\mathbf{36}_b$ which are arranged in parallel and which are regulatable separately. In this case for example the feed line from the melting current supply means $\mathbf{36}_b$ which is at the left in FIG. 4 is taken to the bottom plate 14 and the remelt ingot 30 by way of the line $\mathbf{31}_a$, the feed line from the central melting current supply means $\mathbf{36}_a$ is taken to at least one current-conducting element $\mathbf{18}_a$ by way of the line 31 and the feed line from the right-hand melting current supply means 36 is taken to the melting electrode 28 by way of the line 32. A common return line is returned to the three current supply means 36, $\mathbf{36}_a$, $\mathbf{36}_b$ from at least one further current-conducting element 18 which is insulated with respect to the first element and with respect to the lower and the upper regions 20 and 22 respectively of the mold 10. The individual circuits can be interrupted by way of heavy-current switches 41, $\mathbf{41}_a$, $\mathbf{41}_b$ in the return line 35 or branch lines $\mathbf{37}_a$, $\mathbf{37}_b$ respectively. That arrangement permits different modes of operation. If three parallel-connected alternating current sources 36, $\mathbf{36}_a$, $\mathbf{36}_b$ are used as the melting current supply means, independently adjustable currents can be passed by way of each of the feed lines 32, 31, $\mathbf{31}_a$.

The three current supply means or current sources 36, $\mathbf{36}_a$, $\mathbf{36}_b$ can however also be connected for example to the three phases of a three-phase current supply means, with the return being taken to the star point. In that way it is possible to build up in the slag bath and the metal sump, a stirring movement which is induced by the rotating field. It is however also possible for the electrode 28 and the bottom plate 14 to be connected as the cathode if direct current sources are used as the current sources or melting current supply means 36 and $\mathbf{36}_b$, in which case the individual current strengths can be adjusted and regulated independently of each other. As the current supply means $\mathbf{36}_a$, it is then possible to use an alternating current source which provides for efficient heating of the slag bath 24 by way of the current-conducting elements 18, $\mathbf{18}_a$ of the mold 10.

By exchanging the electrodes 28, it is also possible to produce long remelt ingots in the installations according to the invention—irrespective of the electrode length.

The electrode 28 and the slag bath 24 can be protected from the access of air by gas-tight hoods (not shown here) which can also be sealed off in relation to the mold flange. In that way the remelting procedure can take place under a controlled atmosphere and with the exclusion of oxygen in the air, thereby also making it possible to produce remelt ingots 30 of very high purity and preventing elements with affinity from oxygen from burning away.

What is claimed is:

1. A method for producing a molten metal ingot in a water-cooled mold comprising a mold, a bottom plate movable in the mold, a remelt ingot on the bottom plate, a molten bath sump on the remelt ingot, a slag bath on the molten bath sump and a consumable melting electrode contacting the slag bath, comprising the steps of:

providing a first current conducting element on the mold and a second current conducting element on the mold;

insulating the first current conducting element from the second current conducting element;

selectively controlling a feed of melting current to the slag bath by means of at least one of the consumable melting electrode, the bottom plate and the first current conducting element; and removing current from the slag bath by means of the second current conducting element which is insulated from the first current conducting element on the mold.

2. A method as set forth in claim 1, wherein the proportion of the melting current supplied to the bottom plate is between 0 and 100% of the total melting current.

3. A method as set forth in claim 1, wherein the proportion of the melting current supplied to the consumable melting electrode is between 0 and 100% of the total melting current.

4. A method a set forth in claim 1, wherein the proportion of the melting current supplied to the first current conducting element is between 0 and 100% of the total melting current.

5. A method as set forth in claim 1, wherein the melting current is direct current and one of the consumable electrode and bottom plate is connected as a cathode.

6. A method as set forth in claim 1, including continuously withdrawing the ingot from the mold.

7. A method as set forth in claim 6, wherein the ingot is withdrawn from the mold stepwise.

8. A method as set forth in claim 1, wherein the ingot is stationary and the mold is continuously lifted.

9. A method as set forth in claim 1, wherein the ingot is stationary and the mold is lifted stepwise.

10. A method as set forth in claim 1, wherein the mold is oscillated.

11. A method as set forth in claim 8, wherein the lifting is followed directly by an opposite lifting in the opposite direction, wherein the length of the opposite lifting is at most 60% of the stroke length of the preceding lifting.

12. A mold for producing molten metal ingots comprises:

a bottom cooled mold;

a bottom plate movable in the mold;

a consumable electrode extending into the mold;

a first current conducting element on the mold;

a second current conducting element on the mold wherein the second current conducting element is insulated from the first current conducting element and a portion of the mold;

separate feed lines for feeding melting current to the bottom plate, the consumable electrode and the first current conducting element, respectively;

means for selectively feeding melting current to the separate feed lines; and a return line connected to the second current conducting element for removing current.

13. An apparatus as set forth in claim 12, wherein the means for feeding current comprises two or three mutually independently regulatable current sources.

14. An apparatus as set forth in claim 12, wherein the means for feeding current is connected to the first current conducting element on the mold and to the melting electrode and the bottom plate.

15. An apparatus as set forth in claim 13, wherein one of the two current sources is connected to the second current conducting element on the mold and the other of the two current sources is connected to the melting-electrode and to the bottom plate.

16. An apparatus as set forth in claim 13, wherein a first current source is connected to the electrode, a second current source is connected to the bottom plate and a third current source is connected to the second current conducting element of the mold.

17. An apparatus as set forth in claim 12, wherein the separate individual feed lines include regulatable resistors for adjusting current strength.

18. An apparatus as set forth in claim 13, wherein the three current sources are connected to a three-phase current network.

19. An apparatus as set forth in claim 13, wherein a rectifier installation is provided as the current source.

* * * * *